United States Patent [19]

Hirsch

[11] Patent Number: 4,921,111

[45] Date of Patent: May 1, 1990

[54] DEVICE FOR DISPLAYING MERCHANDISE

[75] Inventor: Hermann Hirsch, Klagenfurt, Austria

[73] Assignee: Hirsch Armbander Gesellschaft m.b.H., Klagenfurt, Austria

[21] Appl. No.: 282,254

[22] Filed: Dec. 9, 1988

[30] Foreign Application Priority Data

Jul. 4, 1988 [DE] Fed. Rep. of Germany ... 8808556[U]

[51] Int. Cl.[5] ..... A47F 7/00

[52] U.S. Cl. ..... 211/13; 211/126; 211/205

[58] Field of Search ..... 211/13, 126, 205, 133, 211/128, 162, 88, 50; 206/301, 45.11; 312/350

[56] References Cited

U.S. PATENT DOCUMENTS 3,993,196 11/1976 Immordino .
4,767,088 8/1988 Fielder et al. ..... 211/205 X

FOREIGN PATENT DOCUMENTS 249310 9/1966 Austria .
292957 9/1971 Austria .
348186 2/1979 Austria .
349684 4/1979 Austria .
96780 5/1981 Austria .
2639288 12/1977 Fed. Rep. of Germany .
87019981 7/1987 Fed. Rep. of Germany .
2341292 9/1977 France .
2027336 2/1980 United Kingdom ..... 211/133

*Primary Examiner*—Blair M. Johnson
*Attorney, Agent, or Firm*—Young & Thompson

[57] ABSTRACT

Device for displaying merchandise, especially watchbands packaged in boxes (3). At least two carriers (2) exhibiting holding compartments (15) for the merchandise are provided, the carriers (2) being affixed to a column (4) projecting upwardly from a base section (1).

The carriers (2) possess a substantially rectangular outer contour and have, on one of their sides, a substantially triangular extension (7) at which is arranged at least one undercut rib (9, 10), the latter being inserted in a slot (5) at the upwardly projecting column (4) of the base section (1).

19 Claims, 5 Drawing Sheets

Fig. 3
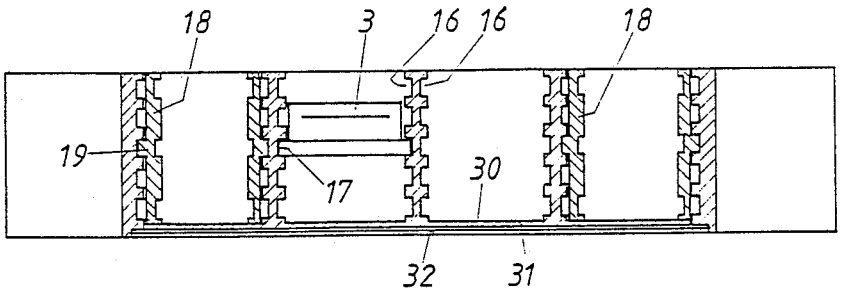
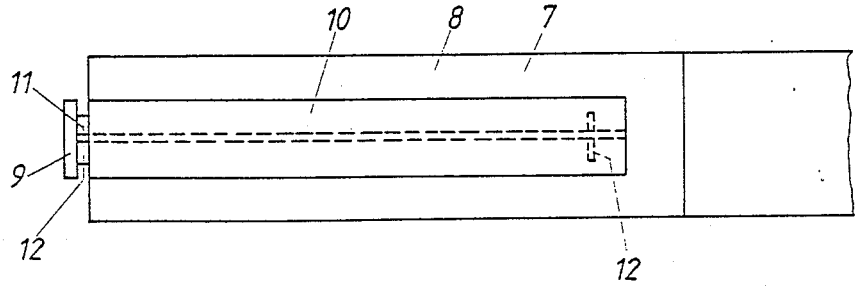
Fig. 4

DEVICE FOR DISPLAYING MERCHANDISEThe invention relates to a device for displaying merchandise, particularly watchbands packaged in boxes.

Merchandise display devices have been known in a great variety of designs. Such devices, also called "sales racks", serve, for example, for offering for sale watchbands that have been packaged in, for instance, transparent synthetic resin boxes. Such boxes have been known from Austrian Patents Nos. 292,957; 348,186; and 349,684. A version of such a synthetic resin box has also been disclosed in Published Austrian Application 96 780.

Sales racks for watchbands packaged into boxes have been known from the three above-mentioned Austrian patents and additionally from Austrian Patent No. 249,310.

The invention is based on the object of providing a device of the aforementioned type having a maximally simple structure and being composable from synthetic resin parts producible, for example, by the injection molding method, this device exhibiting a shape attracting the attention of prospective buyers.

This object has been attained according to this invention by providing at least two carriers which comprise holding compartments for the merchandise, and by affixing the carriers to a column that projects upwardly from a base section. In this connection, the carriers preferably have a substantially rectangular outer contour and exhibit on one of their sides a substantially triangular extension carrying at least one undercut rib, this rib being inserted in a slot provided at the upwardly projecting column of the base section.

The device of this invention for displaying merchandise possesses an especially striking configuration on account of its obliquely upwardly pointing carriers for the merchandise. Yet, the device is rugged and is made up of a small number of individual parts which latter, in addition, exhibit a simple shape. Further details and features of the invention can be seen from the dependent claims as well as from the following description of the embodiment represented in the drawings in partially schematic views. In the drawings:

FIG. 3 is a section along line III—III in FIG. 2,

FIG. 4 is a plan view of a detail according to part 4 in FIG. 2,

Figure 6:
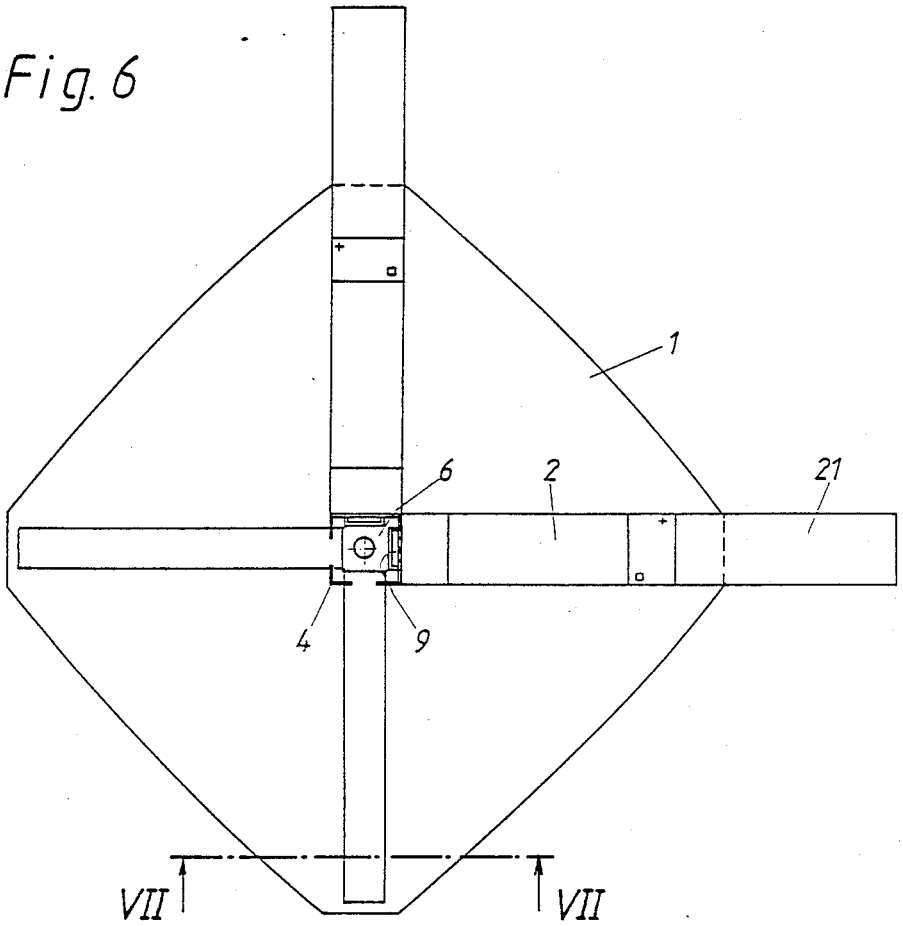
FIG. 6 is a top view of the device according to this invention.
Figure 7:
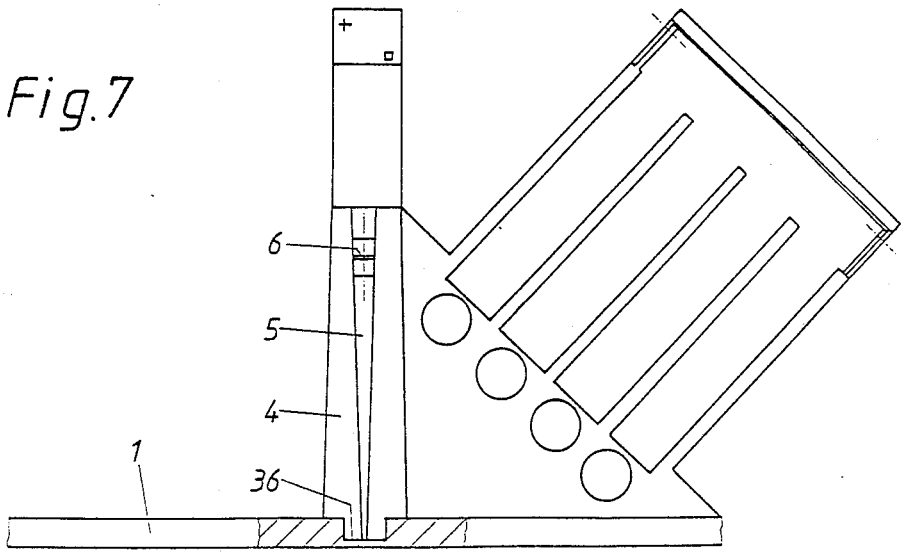

FIG. 7 is a section along line VII—VII in FIG. 6. A device illustrated in FIG. 1 consists of a base section 1 to which are attached four carriers 2 for watchbands packaged in boxes 3.

As can be seen from FIG. 7, the base section 1 has in its center an upwardly projecting column 4 which (cf. FIG. 6) is made of a square configuration in the illustrated embodiment. A slot 5 that tapers from the top toward the bottom is provided in each sidewall of column 4. In order to hold the column and, respectively, its walls together also in the upper end zone of the column 4, a connecting member 6 joining the walls is provided. Preferably, the base section 1 including its column 4 and the connecting member 6 is manufactured in one piece of a synthetic resin, for example by the injection molding process.

The carriers 2 for the merchandise packed into boxes 3 are made of a substantially rectangular form and exhibit at one end an approximately triangular extension 7. Ribs 9 and 10, T-shaped in cross section, are arranged on the forward surfaces 8 of the triangular extension 7. The webs 11 of the ribs 9 and 10 are designed to be of th same width over the entire length of the ribs. In order to securely retain the carriers 2 at the column 4 of the base section 1, a cross web 12 is provided at one end of each rib, this cross web being approximately of such a length that it is seated without clearance, or with only minor play, in the wider end of the slot 5 of column 4 at the base section 1 once a carrier 2 has been mounted on the column 4. The rib of the triangular extension 7, not affixed to the column 4, is received in a groove 36 arranged in the base section 1 and leading from the column 4 to the rim of the base section 1.

In the illustrated embodiment, four holding compartments 15 for watchbands packaged in synthetic resin boxes 3 are disposed in the rectangular portion of the carrier 2. Grooves 16 are provided on the lateral boundary walls of the holding compartments 15, formed in the zone of one of the lateral surfaces of carrier 2 and being open toward the end of the carrier facing away from the triangular extension 7; the boxes 3 engage into these grooves with their projecting rims 17.

Since narrower boxes 3 are utilized for ladies' watchbands, one embodiment of the invention provides the possibility of placing inserts 18 into the holding compartments 15, these inserts having an essentially U-shaped configuration. The two longitudinal walls of the inserts 18 have respectively one rib 19 on the outside, engaging into one of the grooves 16 of the holding compartments 15, as shown in FIG. 3.

Figure 2:
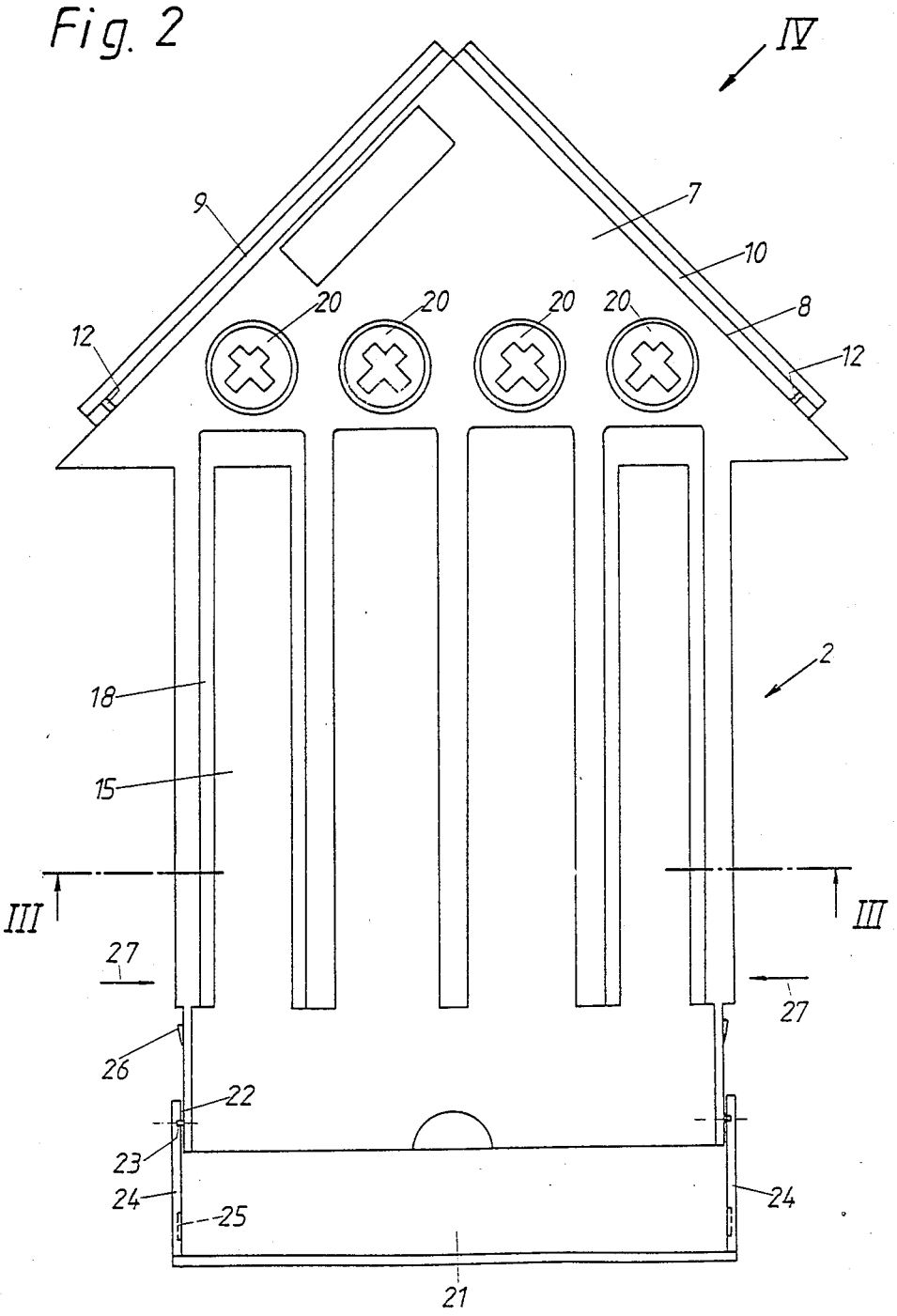
FIG. 2 shows a carrier.

FIG. 2 also shows that, in the triangular extension 7 of the carrier 2, each of the four holding compartments 15 is associated with a recess 20 into which inserts can be placed carrying information regarding the merchandise (watchbands) contained in the holding compartments 15.

A swivelable lid 21 is associated with the ends of the carriers 2 pointing away from the base section 1. The swivel axis of the lid 21 with respect to the carrier 2 is defined by pivot pins 22 engaging into recesses 23 of the lid 21. The lid 21 is retained, in its closed position, at the sidewalls of the carrier 2 by means of wedge-shaped projections 26 engaging into depressions 25 provided in its side faces 24. The lid 21 can be opened again only when the two sidewalls of the carrier 2 are made to somewhat approach each other approximately in the region of the arrows 27 illustrated in FIG. 2. Accordingly, it is assured that the lid 21 cannot be readily opened, and ordinarily only with the aid of both hands so that a certain safety against theft by unauthorized removal of merchandise from the carrier 2 is ensured since the lid 21 prevents removal of boxes 3 from one of the holding compartments 15 of the carrier 2 while this lid is closed.

Figure 1:
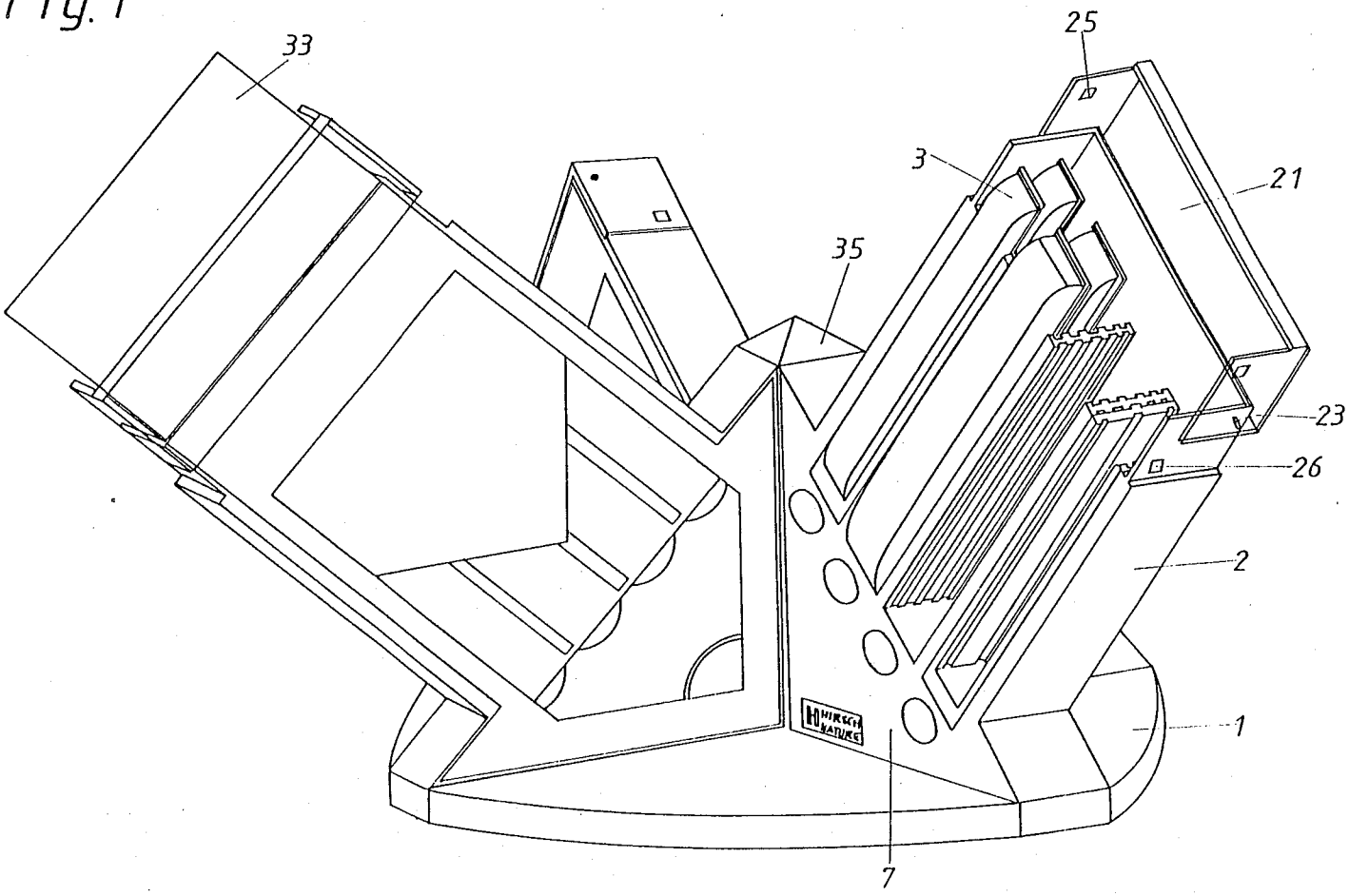
FIG. 1 shows a device in a perspective view.
Figure 5:
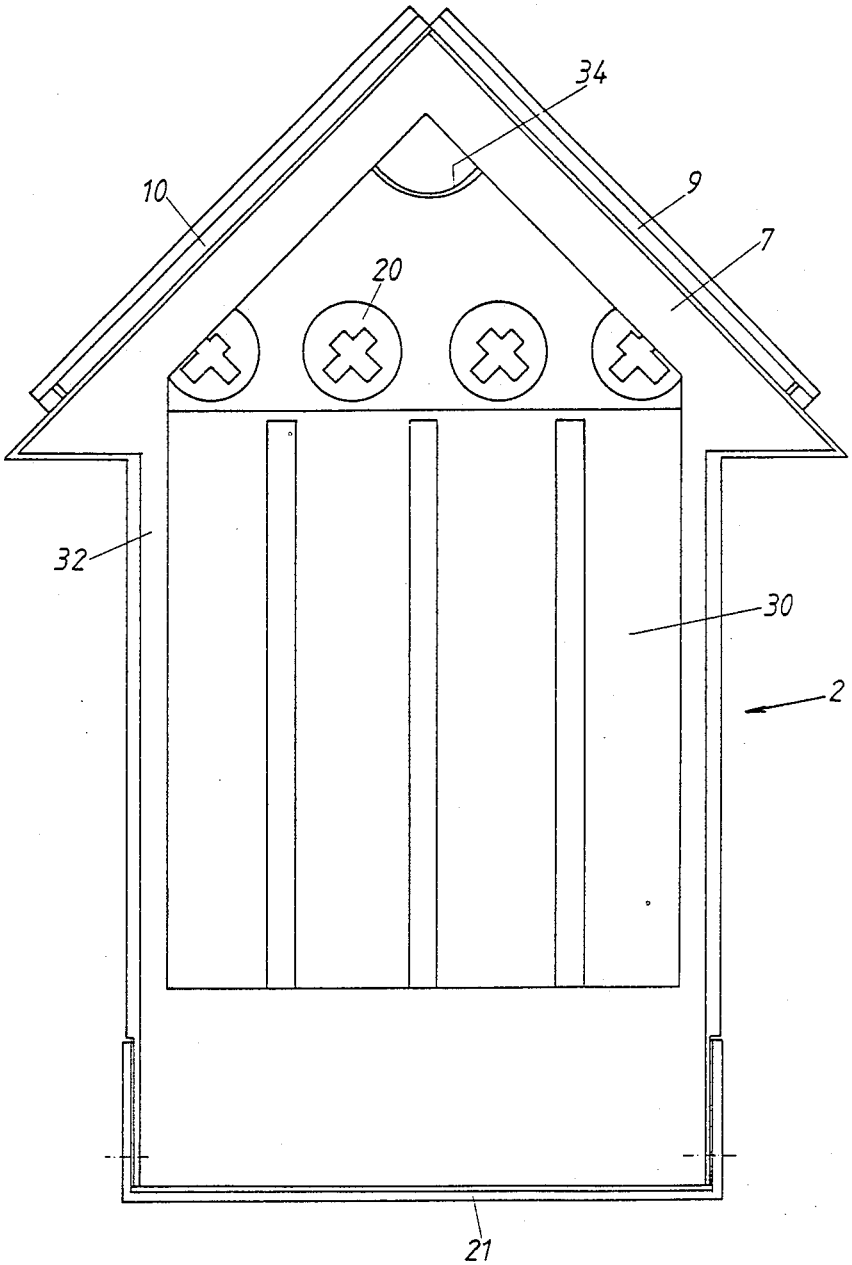
FIG. 5 is a carrier in a view from the rear.

As shown in FIGS. 3 and 5, the triangular extension 7 is fashioned to be hollow, and on the outside of the rear wall 30 of the holding compartments 15 a holding space 31 is formed for a pictorial illustration, this space being delimited by a frame 32 connected with the carrier 2. In this way, as shown in FIG. 1, a picture or some other advertising vehicle 33 can be inserted at each of the carriers 2. In order to keep the advertising vehicle 33 flat even in the zone of the cavity of the triangular extension 7, a support 34 is provided which extends to closely underneath the frame 32.

The device of this invention can be set up as is on a sales counter or the like. However, it is also possible to place the device according to this invention onto a bottom part so that it is rotatable.

It can furthermore be seen from FIG. 1 that the upper end of the column 4 is sealed by a pyramid-shaped closure cap 35.

I claim:

1. Device for displaying merchandise, especially watchbands packaged into boxes (3), comprising at least two elongate carriers (2) having holding compartments (15) for the merchandise, the carriers (2) being affixed to a column (4) projecting upwardly from a base section (1), wherein the carriers (2) have a substantially rectangular portion at one end thereof and exhibit, on the other end thereof, a substantially triangular extension (7), at least one undercut rib (9, 10) being arranged at this extension, this rib being inserted in a slot (5) at the upwardly projecting column (4) of the base section (1) whereby the triangular extension has one angular surface parallel to the column and another angular surface parallel to the base section, whereby the rectangular portion extends at an angle from said column and said base section.

2. Device according to claim 1, characterized in that the triangular extension (7) is fashioned to be hollow.

3. Device according to claim 2, characterized in that a supporting means (34) for a sheet (33) is provided in the zone of the forward tip of the triangular extension (7).

4. Device according to claim 1, wherein characterized two undercut ribs (9, 10) are provided at the triangular extension (7) of the carrier (2).

5. Device according to claim 1, characterized in that the two undercut ribs (9, 10) have an essentially T-shaped cross-sectional configuration.

6. Device according to claim 1, characterized in that the column (4) provided at the base section (1) has a polygonal cross section and exhibits on each of its lateral surfaces a slot (5) for the accommodation of a carrier (2).

7. Device according to claim 1, characterized in that the slot (5) is fashioned to taper from the top toward the bottom.

8. Device according to claim 7, characterized in that the ribs (9, 10) arranged at the carrier (2) each have a web (11) exhibiting a uniform width, and each have a cross web (12) in the zone of one end, the width of this cross web corresponding to the width of the slot (5) at the top of the slot.

9. Device according to claim 1, characterized in that the holding compartments (15) for the merchandise in the carrier (2) are fashioned to be open on their sides lying in opposition to the triangular extension (7).

10. Device according to claim 1, characterized in that the walls of the holding compartments (15) for the merchandise exhibit grooves (16) for the accommodation of projecting marginal strips (17) of boxes (3).

11. Device according to claim 10, characterized in that approximately U-shaped inserts (18) are placed into several of the holding compartments, these inserts exhibiting on two opposite outer sides at least respectively one projecting strip (19); that the strips (19) engage into respectively one of the grooves (16) on the sidewalls of the holding compartments (15); and that the inserts(18) exhibit, on two of their opposed inner sides, grooves for the accommodation of projecting marginal strips (17) of narrower boxes (3).

12. Device according to claim 1, characterized in that recesses (20) which are circular, for example, are arranged in the triangular extension (7) of the carrier (2), for the reception of labels with information regarding the merchandise contained in the packages, the recesses being aligned with respect to the holding compartments (15).

13. Device according to claim 9, characterized in that a swivelable lid (21) is provided at the carrier (2) in the zone of the open of the holding compartments (15).

14. Device according to claim 13, characterized in that the lid (21) is held in its closed position by a locking connection (25/26).

15. Device according to claim 14, characterized in that the locking connection is formed of at least one projection (26) that becomes thicker from the free end of the carrier (2) to the triangular extension (7), this projection engaging, in the closed position of the lid (21), into a recess (25) in lateral flanks (24) of the lid (21).

16. Device according to claim 1, characterized in that the holding compartments (15) for merchandise of each carrier are closed on one side by a, boundary wall (30).

17. Device according to claim 16, characterized in that a holding space (31) for a sheet (33) carrying printed material or pictorial illustrations is provided in the zone of the, boundary wall (30) on its side facing away from the holding compartments (15).

18. Device according to claim 1, characterized in that the sidewalls defining the slots (5) in the column (4) are connected, in the upper zone thereof, by means of a connecting member (6).

19. Device according to claim 1, characterized in that the upper end of the column (4) is sealed by a closure cap (35).

* * * * *